United States Patent [19]

Ortemond

[11] 4,144,940

[45] Mar. 20, 1979

[54] METHOD AND APPARATUS FOR INSTALLING AN OFFSHORE PILE DRIVING RIG

[76] Inventor: Leon D. Ortemond, P.O. Box 53526, Lafayette, La. 70505

[21] Appl. No.: 765,918

[22] Filed: Feb. 7, 1977

[51] Int. Cl.[2] ..... E21B 7/12

[52] U.S. Cl. ..... 175/5; 175/9; 405/195

[58] Field of Search ..... 175/5, 9, 8; 61/86, 61/88, 96, 53.5; 214/12, 14; 212/3; 254/139.1; 52/116, 117, 119

[56] References Cited

U.S. PATENT DOCUMENTS

| | | | |
|---|---|---|---|
| 2,865,179 | 12/1958 | McNeill | 61/96 |
| 3,385,014 | 5/1968 | Haug | 52/116 |
| 3,451,493 | 6/1969 | Storm | 175/9 |
| 3,459,259 | 8/1969 | Matthews | 175/7 |
| 3,751,390 | 8/1973 | Mott et al. | 61/53.5 X |
| 3,825,076 | 7/1974 | Kolb | 175/5 |
| 3,857,247 | 12/1974 | Phares | 61/53.5 X |
| 3,878,662 | 4/1975 | Cernosek | 52/745 |
| 3,961,673 | 6/1976 | Wolters et al. | 175/9 X |

*Primary Examiner*—Ernest R. Purser
*Assistant Examiner*—Richard E. Favreau
*Attorney, Agent, or Firm*—Bernard A. Reiter

[57] ABSTRACT

A method and apparatus for driving conductor pipe in an offshore drilling platform including the steps of mounting a block and tackle on the platform and then lifting a crane onto the platform with it before the drill rig is placed thereon, and driving the conductor pipe through use of a pile driver brought onto the platform with the crane, thus avoiding utilization of either a derrick barge or a drill rig for the conductor pipe driving functions.

16 Claims, 8 Drawing Figures

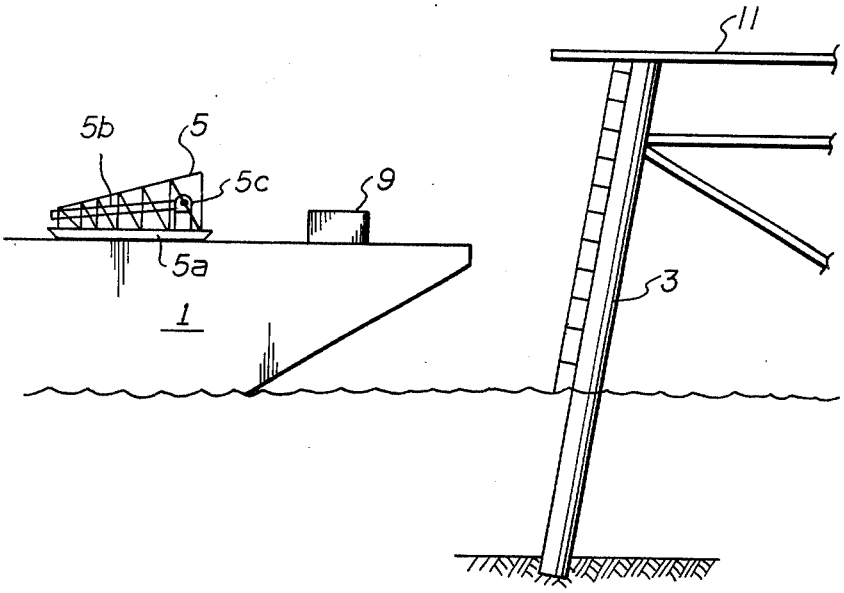
fig.1
fig.2
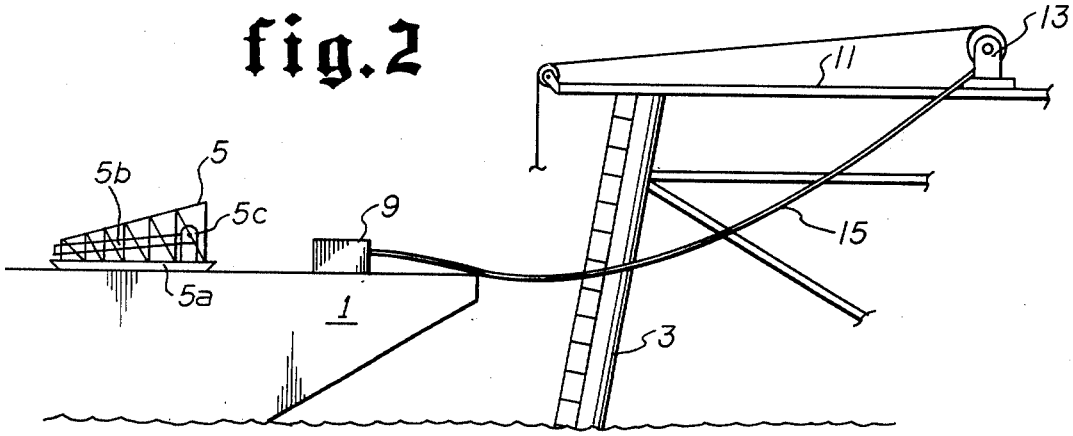
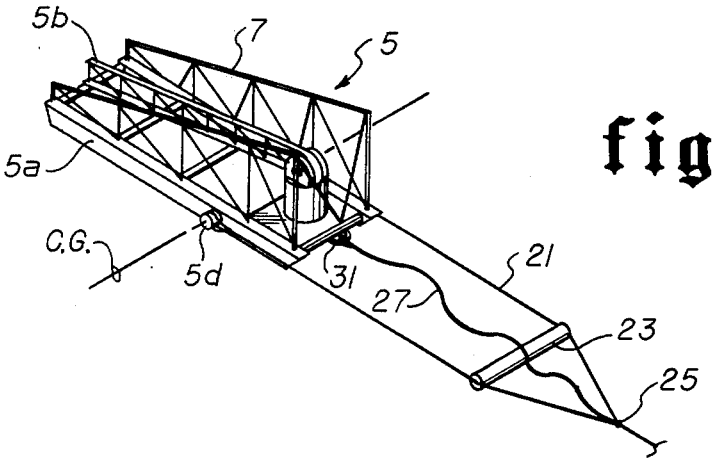
fig.3

METHOD AND APPARATUS FOR INSTALLING AN OFFSHORE PILE DRIVING RIG

BACKGROUND OF THE INVENTION

This invention relates to drilling operations associated with the setting of piling on offshore well drilling platforms and for driving conductor pipe through templates in the jacket thereof. More particularly, this invention, in an important aspect, relates to a method for installing a pile driving atop an offshore platform for driving conductor pipe, independently of a derrick barge or drilling rig.

Heretofore offshore operations preparatory to drilling have commonly been performed by utilizing a derrick barge to transport all necessary men and equipment to the offshore drilling site at which the barge is used as a base platform for driving the pile used to stabilize the legs of the jacket and for performing many other preliminary operations such as welding the platform and driving conductor pipe. Commonly, a pile driving rig is mounted on the derrick barge to perform the pile driving function. Also, the use of drilling rigs for driving pile on the platform is not uncommon. Use of drill rigs constitutes, however, an extremely expensive method for driving pile. Similarly, although derrick barges constitute an excellent platform for a base of operations, in calm weather conditions their use for pile or conductor pipe driving is a particularly uneconomical method for the construction of an offshore drilling platform since the day-to-day cost exceeds that of the drill rig even.

Commonly, the derrick barge is used to transport the drill rig to the well site. There the drill rig may be used to pick up the deck sections and to place them on the top of the legs of the offshore platform. The barge is not uncommonly used as a base of operation for the welding process which takes place when the jacket and the platform is utilized. Also, the derrick barge may remain on site to drive conductor pipe. After the platform is secure the derrick barge generally begins the operation of placing the drilling rig onto the platform.

Since the scarcity of petroleum products began and the costs thereof have increased, the cost of exploring for and retrieving oil and gas have taken on additional importance and the industry has begun to seek ways to reduce the costs involved. One substantial potential cost reduction would take place if a method were conceived in which there were less utilization of the derrick barge and/or drill rig, at least until the time that these pieces of equipment were absolutely necessary for their basic functions. Thus, it becomes advisable, for example, to not use the derrick barge as a base for the driving of conductor pipe but to instead use a less expensive piece of equipment. An even more economical method would be to provide for emplacement of the piling and the conductor pipe without the derrick barge or the drill rig. Heretofore, no satisfactory method for accomplishing this has been known.

BRIEF SUMMARY OF THE INVENTION

In accordance with the invention, there is provided a method and apparatus whereby the derrick barge and drill rig are not used for driving pile and/or conductor pipe. Instead, a conventional barge or work vessel may transport the requisite equipment to the legs of the offshore platform. Included in the equipment and supplies normally transported to the site, there additionally is, in accordance with the invention, transported a pile driving rig, a module crane and a portable winch which, through the method hereof, is mounted on the platform. After establishing the winch on the platform, in any of several ways, it is used to raise the modular crane from the barge to the deck of the platform. The modular crane is then erected and is used to bring the pile driving rig to the platform deck. The pile driving rig is erected on the platform deck and skidded or moved from slot to slot for the purpose of driving pile and/or conductor pipe into the receptacles of the platform. Numerous advantages accrue from the aforementioned method.

First of all, once the platform sections are set on the jacket, the derrick barge may depart the area since the pile and conductor pipe may be driven by the present method. The ability to complete the platform in the absence of the derrick barge results in substantial savings.

Furthermore, once the pile driving machine is established on the platform the piles may be driven and the conductor pipe placed without the use of a derrick drill rig, this further resulting in substantial savings.

Still further, it will be recognized that the personnel may proceed to drive the pilings, weld the platform, set the conductor pipe and do all other necessary construction in anticipation of drilling, independently of ocean conditions such as rough seas which frequently hamper if not preclude continuous day-to-day performance of the functions when they are carried out from the deck of the derrick barge itself. Although other patents have directed themselves to accomplishment of this particular feature, (see U.S. Pat. No. 3,825,076), none have been able to do so without the continued presence of the derrick barge itself.

These and numerous features and advantages of the invention will become more readily apparent upon a reading of the following detailed description, claims and drawings.

DETAILED DESCRIPTION

With reference now to the drawings and particularly to FIGS. 1–5 there is shown a sequence of illustrations setting forth in exemplary form the steps for accomplishing the invention.

Figure 6:
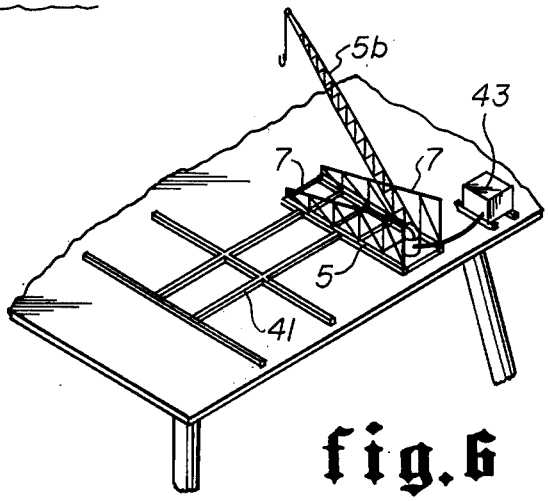
Figure 8:
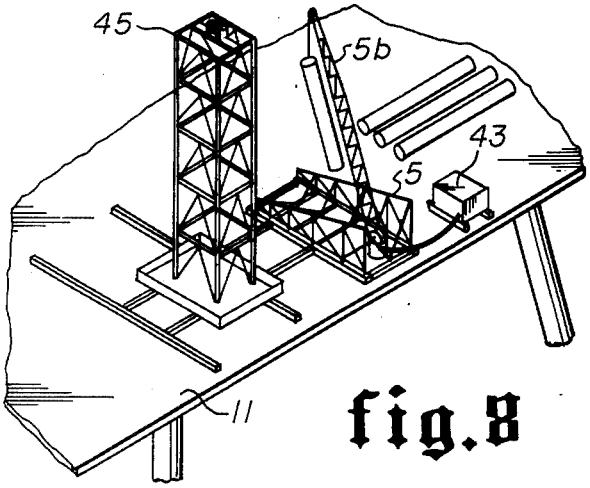
Figure 7:
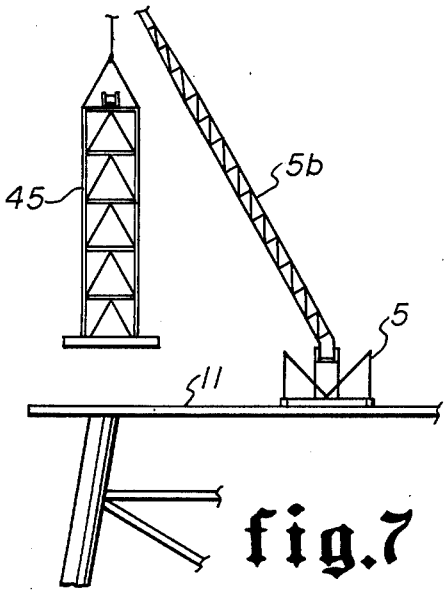

FIGS. 6 to 8 illustrate steps relating to another aspect of the invention.

In FIG. 1 there is shown a conventional barge or boat 1 which has approached and is held adjacent to the jacket legs 3 of an offshore platform. Carried on the deck of the barge is a crane module 5. The crane module includes a base means or skid **5*a*, a crane tower and associatad structure 5*b* and a block and pulley means 5*c*. The module is further characterized by the parallel rails 7 which serves as sides on the module base for protecting the crane tower during shipment and lifting onto the platform, see FIG. 3. Also carried on the deck of the barge 1 is a conventional power generator 9** or diesel engine.

After the barge has established its position with respect to platform legs 3 there is manually carried onto the deck 11 of the platform a plurality of machinery components constituting a portable lifting means such as block and pulley system 13. The block and pulley system is appropriately affixed on the deck and a power line 15 is connected thereto from the generator 9. The cable from the block and pulley is thereafter lowered to the barge 1 in order to be connected to the aforementioned module 5, see FIG. 3. It will be recognized that the block and pulley 13 and associated cable can of course be brought to the deck of the platform in the most facile manner so that the aforementioned manual transportation of the block and pulley up the stairs (see FIG. 2) of the platform may be replaced by utilization of a crane or other means that may exist on the deck of the barge of vessel 1.

In FIG. 3 there is shown an enlarged view of module 5, thus more clearly illustrating the side rails 7 and the crane tower 5*b* disposed therebetween. The crane includes connection points 5*d* on each side of the skid means 5*a*, the connection points being so disposed along the length of the skid means as to substantially coincide with the center of gravity of the module. A harness 21 is affixed to connection points 5*d* and includes a spreader bar 23 for keeping the harness cables in parallel relation to the skid means 5*a*. The cables of harness 21 meet at common point 25 at which there is also attached the moment arm cable means 27. The cable 27 extends from common point 25 to the end of the skid means 5*a* and has a length which is greater than the linear distance from common point 25 to the point at which cable 27 is attached to the skid means. The purpose of the moment arm cable 27 will be more clearly described hereinafter.

Figure 4:
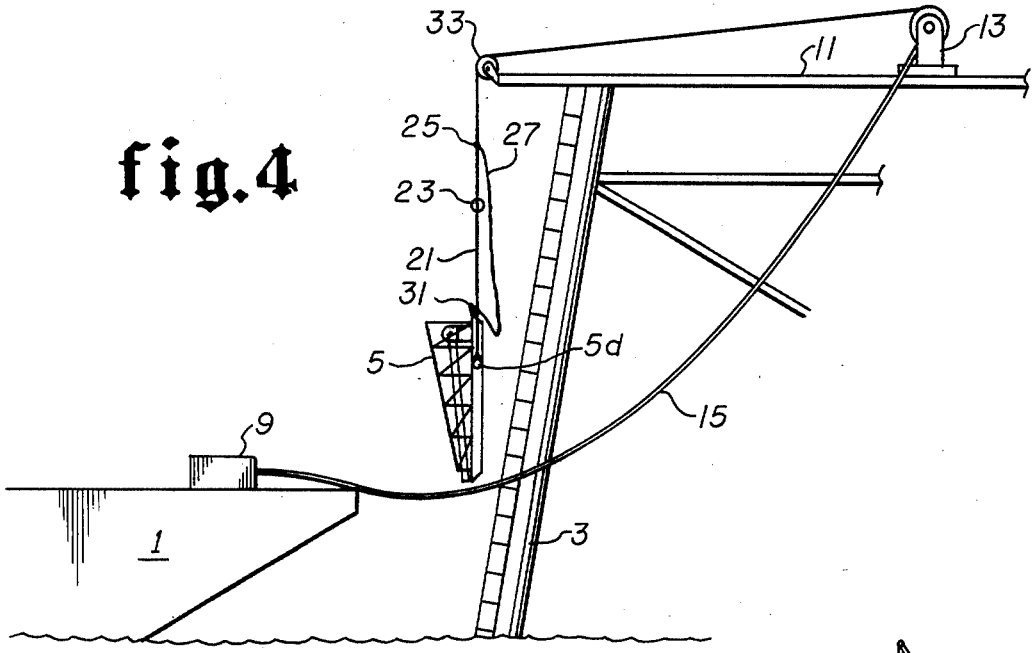
Figure 5:
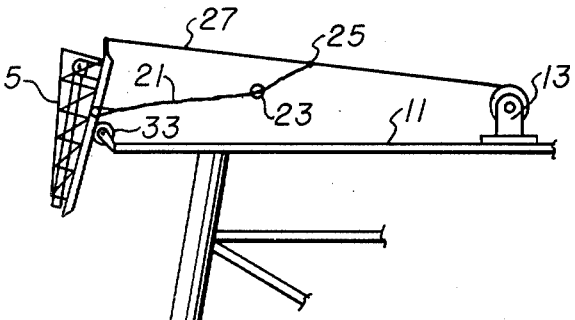

After the clock and pulley system, that is lifting means 13 has been properly disposed and installed on deck 11, the cable wound on the pulley is deployed over the side of the deck where it is dropped to the barge 1 and attached to the skid means 5*a* via the aforementioned harness 21. By utilization of the power generator 9, the module 5 is carefully lifted from the barge upwardly toward the deck 11 of the platform, see FIG. 4. In so doing, the module is adapted to hang in a substantially vertical position due to attachment of the harness 21 at the center of gravity (5*d*) of the module. As the module approaches the level of the platform the cables of harness 21 begin to slacken and the moment arm cable 27 begins to tighten due to the fact that the horizontal distance parallel to the deck between pulley 13 and pulley 33 is shorter than the distance between pulley 13 and module connection point 31. As connection points 5*d* reach the level of pulley 33, the moment arm cable 27 becomes taut and takes over the load previously carried by the harness 21. In so doing, the moment arm cable 27 beings to turn the module about its contact point with the pulley 33 thus enabling movement of the module heavy end first thereabout and toward the deck 11 of the platform. Without utilization of the harness 21 and moment arm cable 27, lifting of the module onto the deck 11 would be significantly hindered or even prevented by the inability of the lifting means or lifting cable to withstand the tension force exerted thereon between the pulleys 13 and 33. As shown in FIG. 5 therefore, the module 5 is slid onto the deck 11 and set upon the transfer skids 41 which enable movement of the crane thereon in longitudinal and lateral directions on the deck. The crane tower 5*b* is deployed to its operating position adjacent the edge of the deck. The power line 15 may, if necessary, be connected to the crane in order to lift a power source 43 onto the deck, after which the power line 15 is disconnected and the crane connected directly to the source of power on the deck.

After the crane is positioned on the deck it is used to sequentially lift and position the transfer skids 41 which may be used to support and enable movement of the pile driving rig. The pile driving rig is then lifted in components from the barge to the deck of the platform and assembled thereon. The pile driving rig may be adapted for movement over the deck by means of the skids or other appropriate structure. In any event, the rig 45 is adapted to be moved from slot to slot on the deck 11 in order to set the conductor pile or drive piles for the jacket legs. Similarly, it may be used to lift other equipment and even supplies and living accommodations to the platform.

From the foregoing it will be recognized that after equipment and supplies are removed from the deck of the vessel the offshore platform becomes relatively self-sufficient so that construction work on the platform may continue independently of any barge or vessel. The derrick barge, if it has been used to set platform sections, is free to depart from the offshore location and thus not be occupied with the driving of conductor pipe or pile and the welding of the legs to the jacket and platform. The barge may however be used to erect the drill rig after the platform is constructed. Thus, it is not necessary to operate the drill rig prior to the initiation of drilling operations since all of the pile driving may be conducted from the deck of the platform by the pile driving rig in accordance with the mounting method disclosed herein.

The present method of utilizing a pile driving rig not only significantly reduces the costs of construction of the offshore platform by more efficient use of the derrick barge and drill rig, but enhances the possibility of continuous operation by removing the pile setting function from the deck of the derrick barge, thus isolating the pile setting from the wave action effect to which the barge is vulnerable. Construction of the platform may thus take place more independently of the weather and surrounding water conditions thus reducing the overall construction time and construction costs.

In addition, it becomes feasible for the pile driving rig to perform any other functions, such as washing out of the pile, in preparation for the actual drilling operation, all of which facilitates construction of the offshore platform and reduces the costs thereof.

Although the present invention has been described with reference to a preferred form and sequence of steps, it will be appreciated that additions, modifications, substitutions and deletions may be made without departing from the spirit and scope of the invention as defined in the appended claims.

That which is claimed and desired to be secured by Letters Patent is:

1. In a method for founding an offshore platform for supporting a drill rig thereon by drilling in pile projecting from a submerged surface to a location above the surface of the water body, the method utilizing lifting means, a module crane and a pile driving rig, the improvement comprising:

transporting the lifting means to the deck of the platform and affixing it thereto, operating the lifting means to dispose the module crane on the deck of the platform, deploying the module crane on the platform deck, operating the module crane to dispose the pile driving rig on the platform deck, and erecting the pile driving rig in operative relation to its intended work object, operating the pile driving rig to accomplish its intended work object, all of the above independently of a barge or drilling rig.

2. The method of claim 1 wherein the portable lifting means is affixed to the platform deck away from the edge thereof over which the module crane is lifted so that the crane may be pulled onto the deck, attaching to the module crane at a point thereon, a cable rigging means extending from the portable lift means, said cable rigging means attached to the module crane so that it hangs substantially vertically as it is lifted from the barge deck, lifting the module crane upwardly until the point of attachment approaches the height of the platform deck and the upper end of the module crane extends thereabove, pulling the upper end of the module crane inwardly toward said portable lifting means so as to thus use that portion of the module crane extending above the deck as a moment arm about the point of attachment, and sliding the module crane onto the platform deck as it is rotated about the point of attachment.

3. The method of claim 2, wherein the cable rigging means includes cable means attached to the upper end of the module crane for facilitating said inward pull of the upper end thereof so that continued pulling on the point of attachment continues until the point of attachment substantially reaches the level of the deck at which time continued pulling on the cable rigging means initiates rotative movement of the crane toward the platform deck.

4. The method of claim 2, wherein the steps recited are performed independently of a drill rig.

5. In a method for founding an offshore platform from a barge in open water disposed adjacent to jacket legs intended to support the platform and drill rig thereon, the method utilizing a portable lifting means, a module crane and pile driving rig, the improvement comprising:

transporting the portable lifting means from the barge to the deck of the platform and affixing the lifting means thereon in operative relation to the deck of the barge, operating the lifting means to raise the module crane from the barge to the platform deck, erecting the module crane on the platform deck in operative relation to the barge, operating the crane to lift the pile driving rig onto the platform deck and assembling the rig thereon, operating the pile driving rig to accomplish its work object independently of the barge so as to enable dismissal of the barge from the locale of the platform.

6. The method of claim 5, wherein the work object of the pile driving rig comprises driving of piles to found the jacket legs of the platform and driving of conductor pipe into the floor beneath the water body, performing the work object of the pile driving rig independently of a drill rig so as to thereby complete the platform at nominal cost for equipment in shortest elapsed time.

7. In a method for founding an offshore platform from a vessel in open water disposed adjacent to jacket legs intended to support the platform and drill rig thereon, the method utilizing a portable lifting means, a module crane and pile driving rig, the improvement comprising:

transporting the lifting means to the deck of the offshore platform and erecting it thereon in operative relation to a vessel adjacent to the platform, coupling the lifting means to a source of power, operating the lifting means to deploy a module crane, erecting the module crane, operating the module crane to deploy the pile driving rig onto the offshore platform, and also lifting power means to the platform for the pile driving rig, deploying the pile driving rig in operative relation to the first intended work object and operating the rig to completion of the work object, redeploying the rig in operative relation to the second intended work object after the work is finished on the first work object and operating the rig to completion thereof, and continuing to redeploy the pile driving rig in subsequent positions on the platform as necessary until the work of the pile driving rig is completed, conducting other work on the platform with the pile driving rig that is otherwise conducted with the drill rig preparatory to the operation of the drill rig for oil and gas drilling purposes, and engaging the drill rig to conduct the oil or gas drilling operations so as to thereby optimize use of the derrick barge and drill rig for their necessary functions while delaying or omitting their use as much as is reasonably practical.

8. The method for mounting a modular crane upon an incomplete platform residing above the surface of a body of water and used for supporting operations for drilling for petroleum products beneath the surface of the body of water, the method utilizing a portable winch means and modular crane comprising the steps of:

transporting the portable winch to the deck of the platform and mounting it thereon at a position distant from the edge thereof over which the modular crane is to be drawn, attaching a line from the winch to the modular crane disposed on a barge beneath the platform, operating the winch to raise the modular crane to the platform deck, and erecting the crane on the deck so that pile driving equipment may be raised thereafter for driving pile and conductor pipe independently of other vessels and equipment.

9. In a method for drilling in a pile projecting from a submerged surface to a position above the surface of a body of water, the method utilizing a pile driving rig and lifting means for disposing the rib on the deck of the platform comprising the steps of:

deploying a lifting means on the platform to move the pile driving rig thereonto and deploying the pile driving rig in its desired position thereon, driving pile with said pile driving rig so as to pin the platform legs to the floor of the body of water, including moving the rig from one position to another on the platform as necessary, completing all other structural operations on the platform including erection of the drilling rig, and operating the drill rig in pursuit of petroleum products.

10. The method of claim 9 including the additional step of driving conductor pipe with said pile driving rig.

11. The method of claim 9, wherein the pile driving rig is transported to the site of the offshore platform on a boat and lifted therefrom, along with living accommodations for a crew to the deck of the platform, thus enabling the driving of pile and other preparatory operations to be carried out and completed independently of the boat.

12. The method of claim 11, wherein the lifting means includes a modular crane characterized by a base and having a heavy end, a light end and a center of gravity therebetween, said lifting means further including a winch, the method further accomplished by the steps of:

mounting the winch on the platform, coupling the winch cable to the center of gravity of the modular crane but with the heavy end upward as it is lifted toward the platform, lifting the modular crane to the platform until the coupling point of the cable to the modular crane approaches the platform deck, rotating the modular crane heavy end toward the deck and simultaneously beginning to slide the modular crane thereon, and erecting the crane so as to lift equipment and supplies thereon.

13. The method of claim 12 including the additional step of operating the modular crane to establish pile-driving equipment on the platform and operating said pile-driving equipment to drive pile and conductor pipe and to perform the function of lifting other equipment and supplies, as necessary, to the deck of the platform.

14. The method for establishing an offshore platform for supporting a drill rig thereon by drilling in pile projecting from a submerged surface to a location above the surface of a body of water, the method utilizing lifting means, a modular crane, and a pile-driving rig, the improvement comprising the steps of:

transporting the lifting means to a position above the projecting pile and anchoring it there at a position proximate the platform edge over which the modular crane is to be drawn, attaching a line from the lifting means to the modular crane disposed on a vessel floating on the water beneath the platform, operating the lifting means to raise the modular crane to the platform deck and erecting the crane on the platform deck so that pile-driving equipment may be raised therewith for driving pile and conductor pipe.

15. In a method for driving pile so as to establish a platform above the surface of a body of water, the method utilizing a pile-driving rig established on the platform for the driving of the pile comprising the steps of:

disposing a portable lifting means on the platform deck in relation to the edge thereof for sequentially lifting a modular crane to the deck, assembling the modular crane on the deck and preparing it to lift a pile-driving rig also onto the deck so that the rig may be used to drive pile into the floor of the body of water, and operating the pile-driving rig to drive pile into the floor of the body of water so as to pin the platform legs into stable position.

16. The method of claim 15 including the additional step of using the pile-driving rig to drive conductor pipe.

* * * * *